US011500314B2

(12) United States Patent
Shoji et al.

(10) Patent No.: US 11,500,314 B2
(45) Date of Patent: Nov. 15, 2022

(54) IMAGE FORMING APPARATUS AND CLEANING METHOD

(71) Applicants: Keitaro Shoji, Kanagawa (JP); Yoshio Hattori, Kanagawa (JP); Yoshikuni Sasaki, Kanagawa (JP); Takahiro Imada, Kanagawa (JP); Hiromasa Takagi, Tokyo (JP); Yasunori Ishigaya, Kanagawa (JP); Takumi Waida, Kanagawa (JP)

(72) Inventors: Keitaro Shoji, Kanagawa (JP); Yoshio Hattori, Kanagawa (JP); Yoshikuni Sasaki, Kanagawa (JP); Takahiro Imada, Kanagawa (JP); Hiromasa Takagi, Tokyo (JP); Yasunori Ishigaya, Kanagawa (JP); Takumi Waida, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/443,462

(22) Filed: Jul. 27, 2021

(65) Prior Publication Data

US 2022/0043376 A1 Feb. 10, 2022

(30) Foreign Application Priority Data

Aug. 7, 2020 (JP) ..... JP2020-134844

(51) Int. Cl.
*G03G 15/20* (2006.01)

(52) U.S. Cl.
CPC ..... *G03G 15/2025* (2013.01); *G03G 15/205* (2013.01); *G03G 15/2064* (2013.01)

(58) Field of Classification Search
CPC ..... G03G 15/2025; G03G 15/205; G03G 15/2064
See application file for complete search history.

(56) References Cited

U.S. PATENT DOCUMENTS 6,094,559 A * 7/2000 Otsuka ..... G03G 15/2025 399/68
2009/0257793 A1* 10/2009 Yoshioka ..... G03G 15/6573 399/327

(Continued)

FOREIGN PATENT DOCUMENTS

| | | |
|---|---|---|
| JP | 10-010910 | 1/1998 |
| JP | 2012-048107 | 3/2012 |
| JP | 2018-017885 | 2/2018 |

*Primary Examiner* — Carla J Therrien
(74) *Attorney, Agent, or Firm* — Xsensus LLP

(57) ABSTRACT

An image forming apparatus includes an image forming device that forms a toner image on a recording medium, a first rotator, and a second rotator that presses against the first rotator to form a nip therebetween. The first rotator conveys the recording medium bearing the toner image through the nip with a first orientation of the recording medium to fix the toner image on the recording medium to create a cleaning sheet bearing a cleaning image in a cleaning sheet creation mode. The first rotator conveys the cleaning sheet bearing the cleaning image through the nip with a second orientation of the cleaning sheet, that is different from the first orientation of the recording medium, such that the cleaning image is disposed opposite the first rotator to cause the cleaning image to remove a foreign substance from a surface of the first rotator in a cleaning mode.

17 Claims, 9 Drawing Sheets

(56) References Cited

U.S. PATENT DOCUMENTS

| | | | | |
|---|---|---|---|---|
| 2012/0189360 | A1* | 7/2012 | Shirai | G03G 15/2025 399/327 |
| 2012/0294642 | A1* | 11/2012 | Kawajiri | G03G 15/2025 399/327 |
| 2016/0041511 | A1* | 2/2016 | Fujii | G03G 15/2025 399/327 |
| 2016/0098004 | A1* | 4/2016 | Shinagawa | G03G 15/5016 399/99 |
| 2017/0205744 | A1* | 7/2017 | Tanaka | G03G 15/2017 |
| 2020/0159148 | A1 | 5/2020 | Imada et al. | |
| 2020/0159149 | A1 | 5/2020 | Waida et al. | |
| 2020/0249603 | A1 | 8/2020 | Ishigaya et al. | |

* cited by examiner

IMAGE FORMING APPARATUS AND CLEANING METHOD

CROSS-REFERENCE TO RELATED APPLICATION

This patent application is based on and claims priority pursuant to 35 U.S.C. § 119(a) to Japanese Patent Application No. 2020-134844, filed on Aug. 7, 2020, in the Japan Patent Office, the entire disclosure of which is hereby incorporated by reference herein.

BACKGROUND

Technical Field

Exemplary aspects of the present disclosure relate to an image forming apparatus and a cleaning method, and more particularly, to an image forming apparatus for forming an image and a cleaning method for cleaning a rotator incorporated in the image forming apparatus.

Discussion of the Background Art

Related-art image forming apparatuses, such as copiers, facsimile machines, printers, and multifunction peripherals (MFP) having two or more of copying, printing, scanning, facsimile, plotter, and other functions, typically form an image on a recording medium according to image data by electrophotography.

For example, such image forming apparatuses include a fixing device that includes a fixing roller and a pressure roller. The fixing roller accommodates a heat source and rotates. The pressure roller rotates while the pressure roller is pressed against the fixing roller. As a recording medium bearing an unfixed toner image passes through a nip formed between the fixing roller and the pressure roller, the fixing roller and the pressure roller melt and fix the unfixed toner image on the recording medium. In order to decrease a thermal capacity of a fixing member such as the fixing roller and improve efficiency in conduction of heat from the fixing member to the recording medium, instead of the fixing roller accommodating the heat source, the fixing device may include a fixing rotator (e.g., an endless belt) and a pressure rotator.

The fixing device may suffer from shortage of heat or overheating that generates offset toner and the like that do not melt properly and do remain on the fixing member. The offset toner remaining on the fixing member may be mixed with other foreign substance such as paper dust and adhered to the fixing member.

SUMMARY

This specification describes below an improved image forming apparatus. In one embodiment, the image forming apparatus includes an image forming device that forms a toner image on a recording medium, a first rotator that rotates in a rotation direction, a second rotator that presses against the first rotator to form a nip between the first rotator and the second rotator, and a heater that heats at least one of the first rotator and the second rotator. The first rotator conveys the recording medium bearing the toner image through the nip with a first orientation of the recording medium to fix the toner image on the recording medium so as to create a cleaning sheet bearing a cleaning image in a cleaning sheet creation mode. The first rotator conveys the cleaning sheet bearing the cleaning image through the nip with a second orientation of the cleaning sheet, that is different from the first orientation of the recording medium, in a state in which the cleaning image is disposed opposite the first rotator so as to cause the cleaning image to remove a foreign substance from a surface of the first rotator in a cleaning mode.

This specification further describes an improved cleaning method. In one embodiment, the cleaning method includes forming a toner image on a recording medium, fixing the toner image on the recording medium to create a cleaning sheet bearing a cleaning image in a cleaning sheet creation mode while conveying the recording medium bearing the toner image through a nip formed between a first rotator and a second rotator in a state in which a first edge of the cleaning sheet is disposed upstream from a second edge of the cleaning sheet in a conveyance direction of the cleaning sheet, and removing a foreign substance from a surface of the first rotator in a cleaning mode while conveying the cleaning sheet bearing the cleaning image through the nip in a state in which the cleaning image is disposed opposite the first rotator and in which the first edge of the cleaning sheet is disposed downstream from the second edge of the cleaning sheet in the conveyance direction of the cleaning sheet.

BRIEF DESCRIPTION OF THE DRAWINGS

A more complete appreciation of the embodiments and many of the attendant advantages and features thereof can be readily obtained and understood from the following detailed description with reference to the accompanying drawings, wherein.

Figure 1:
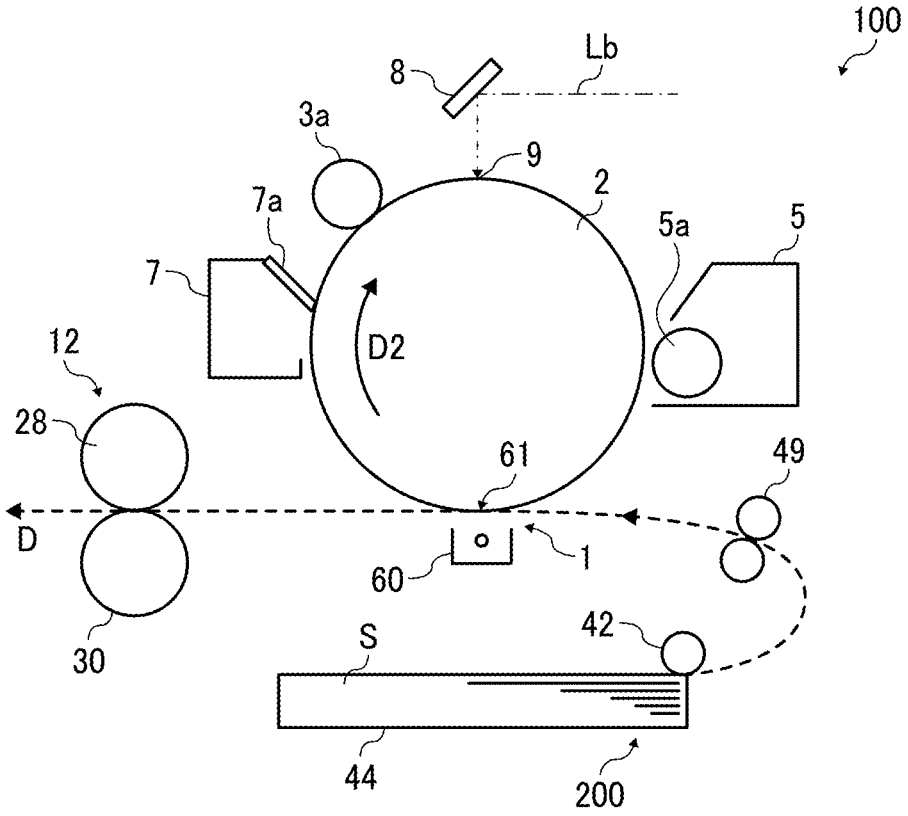
FIG. 1 is a schematic cross-sectional view of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

As used herein, the singular forms "a", "an", and "the" are intended to include the plural forms as well, unless the context clearly indicates otherwise.

Referring to drawings, a description is provided of a construction of an image forming apparatus and a cleaning method according to embodiments of the present disclosure. The technology of the present disclosure is not limited to the embodiments described below and may be modified within scopes suggested by those skilled in art, such as other embodiments, addition, modification, and deletion. The technology of the present disclosure encompasses various embodiments that achieve operations and advantages of the technology of the present disclosure.

According to the embodiments described below, image formation and printing are synonyms.

A description is provided of constructions of image forming apparatuses.

Figure 2:
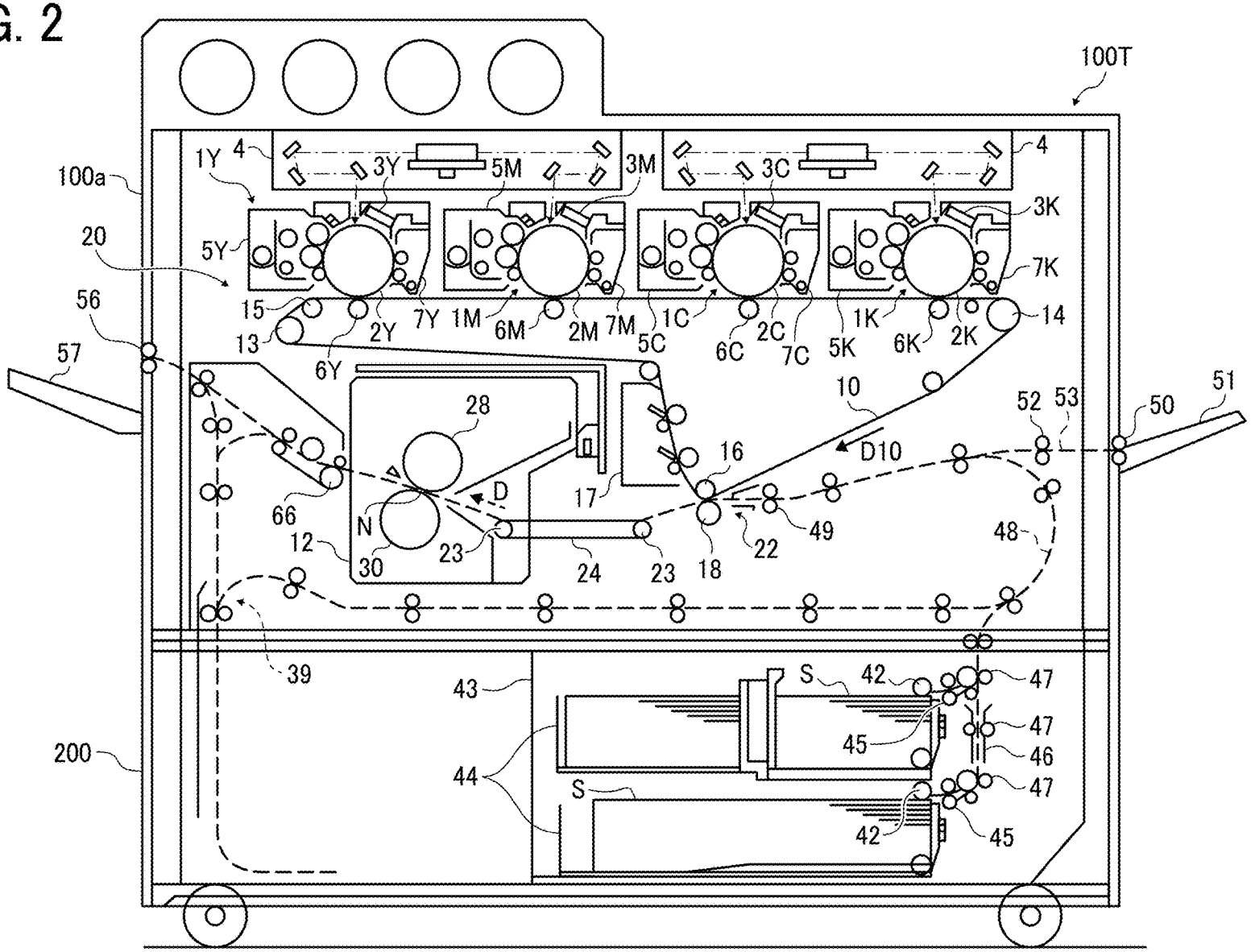
FIG. 2 is a schematic cross-sectional view of another image forming apparatus according to an embodiment of the present disclosure.
Figure 3:
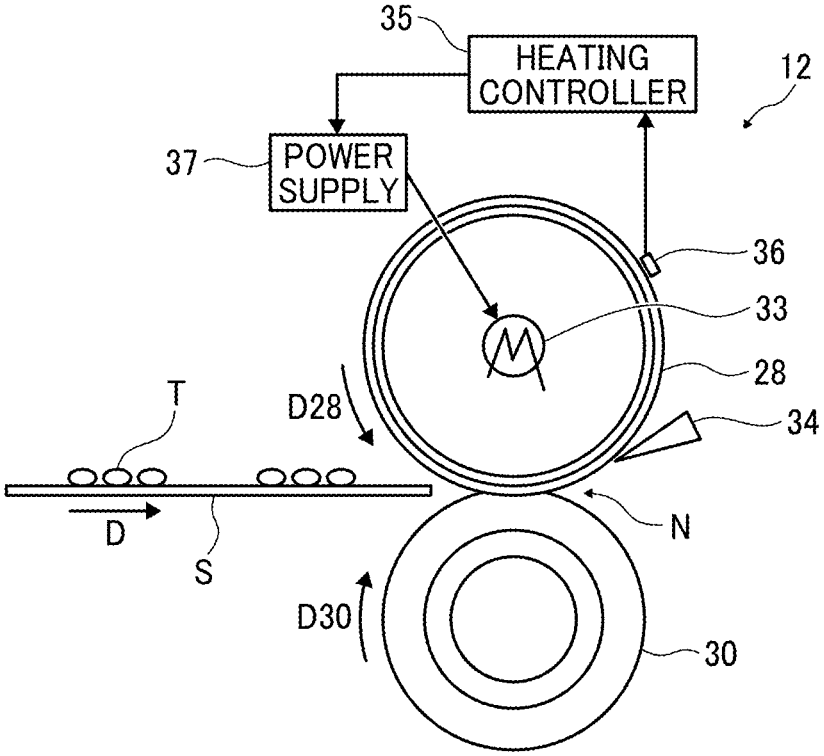
FIG. 3 is a schematic cross-sectional view of a fixing device according to an embodiment of the present disclosure, that is incorporated in each of the image forming apparatuses depicted in FIGS. 1 and 2.

Referring to FIGS. 1 to 3, a description is provided of the constructions of the image forming apparatuses according to embodiments of the present disclosure and a mechanism of each of the image forming apparatuses that employ a cleaning method according to the embodiments of the present disclosure.

Each of the image forming apparatuses according to the embodiments of the present disclosure includes an image forming device that forms a toner image on a recording medium. Each of the image forming apparatuses further includes a fixing device that fixes the toner image on the recording medium. The fixing device includes a fixing rotator that rotates and a pressure rotator that is pressed against the fixing rotator to form a nip therebetween. As the recording medium bearing the toner image is conveyed through the nip, the fixing rotator and the pressure rotator fix the toner image on the recording medium.

FIG. 1 is a schematic cross-sectional view of an image forming apparatus 100, that is, a printer, according to an embodiment of the present disclosure.

As illustrated in FIG. 1, the image forming apparatus 100 includes an image forming device 1, a fixing device 12, a sheet supply 200, and a registration roller pair 49. The image forming device 1 includes a photoconductive drum 2 serving as an image bearer and a transferor 60.

The sheet supply 200 includes a sheet tray 44 and a sheet feeding roller 42. The sheet tray 44 accommodates and loads a plurality of sheets S serving as recording media. The sheet feeding roller 42 separates an uppermost sheet S from other sheets S placed on the sheet tray 44 and feeds the uppermost sheet S to the registration roller pair 49 one by one. The registration roller pair 49 temporarily halts the sheet S conveyed by the sheet feeding roller 42 and corrects skew of the sheet S. Thereafter, at a time that synchronizes with rotation of the photoconductive drum 2, that is, at a time when a leading edge of a toner image formed on the photoconductive drum 2 meets a predetermined position on a leading end of the sheet S in a conveyance direction D of the sheet S, the registration roller pair 49 conveys the sheet S to a transfer position 61.

The photoconductive drum 2 is surrounded by a charging roller 3*a*, a mirror 8, a developing device 5, the transferor 60, a photoconductive drum cleaner 7, and the like that are arranged in a rotation direction D2 of the photoconductive drum 2, that is indicated with an arrow in FIG. 1. The charging roller 3*a* serves as a charger. The mirror 8 serves as a part of an exposure device. The developing device 5 includes a developing roller 5*a*. The photoconductive drum cleaner 7 includes a cleaning blade 7*a* that cleans the photoconductive drum 2.

At a position between the charging roller 3*a* and the developing device 5, the exposure device irradiates an exposure portion 9 on the photoconductive drum 2 with exposure light Lb via the mirror 8 so that the exposure light Lb scans the photoconductive drum 2.

A description is provided of an image forming operation performed by the image forming apparatus 100.

For example, as the photoconductive drum 2 starts rotation, the charging roller 3*a* uniformly charges a surface of the photoconductive drum 2. The exposure device irradiates the exposure portion 9 with the exposure light Lb according to image data so that the exposure light Lb scans the photoconductive drum 2, thus forming an electrostatic latent image to be formed into a toner image. As the photoconductive drum 2 rotates, the electrostatic latent image formed on the photoconductive drum 2 moves to a developing position disposed opposite the developing device 5. At the developing position, the developing device 5 supplies toner to the electrostatic latent image, visualizing the electrostatic latent image into a toner image. The transferor 60 applies a transfer bias that transfers the toner image formed on the photoconductive drum 2 onto the sheet S that enters the transfer position 61 at a predetermined time.

The sheet S bearing the toner image is conveyed to the fixing device 12. After the fixing device 12 fixes the toner image on the sheet S, the sheet S is ejected and stacked onto a sheet ejection tray.

Residual toner failed to be transferred onto the sheet S at the transfer position 61 and therefore remaining on the photoconductive drum 2 reaches the photoconductive drum cleaner 7 as the photoconductive drum 2 rotates. While the residual toner passes over the photoconductive drum cleaner 7, the cleaning blade 7*a* scrapes the residual toner off the photoconductive drum 2, thus cleaning the photoconductive drum 2. Thereafter, a discharger removes residual potential on the photoconductive drum 2 so that the photoconductive drum 2 is ready for a next image forming operation.

FIG. 2 is a schematic cross-sectional view of an image forming apparatus 100T employing a tandem intermediate transfer system according to an embodiment of the present disclosure.

A tandem image former 20 is disposed inside an apparatus body 100*a* of the image forming apparatus 100T. The tandem image former 20 employs the tandem intermediate transfer system. A plurality of image forming devices 1Y, 1M, 1C, and 1K is arranged in the tandem image former 20. Suffixes Y, M, C, and K added to the reference numerals represent colors, that is, yellow, magenta, cyan, and black, respectively.

An intermediate transfer belt 10 is disposed in proximity to a center of the apparatus body 100*a*. The intermediate transfer belt 10 serves as an intermediate transferor, that is, an endless belt. The intermediate transfer belt 10 is looped over a plurality of support rollers 14, 15, 13, and 16 and the like and rotates clockwise in FIG. 2 in a rotation direction D10.

On the left of the support roller 16 in FIG. 2 is an intermediate transfer belt cleaner 17 that cleans the intermediate transfer belt 10. The intermediate transfer belt cleaner 17 removes residual toner remaining on the intermediate transfer belt 10 after the toner image is transferred from the intermediate transfer belt 10.

Four image forming devices, that is, the image forming devices 1Y, 1M, 1C, and 1K that form yellow (Y), magenta (M), cyan (C), and black (K) toner images, respectively, are arranged horizontally in FIG. 2 in the rotation direction D10 of the intermediate transfer belt above an upper portion of the intermediate transfer belt 10, that is stretched taut across the support rollers 14 and 15, thus constructing the tandem image former 20. The image forming devices 1Y, 1M, 1C, and 1K of the tandem image former 20 include photoconductive drums 2Y, 2M, 2C, and 2K serving as image bearers that bear the yellow, magenta, cyan, and black toner images, respectively.

As illustrated in FIG. 2, two exposure devices 4 are disposed above the tandem image former 20. One of the exposure devices 4 is disposed opposite the image forming devices 1Y and 1M. Another one of the exposure devices 4 is disposed opposite the image forming devices 1C and 1K. For example, the exposure device 4 employs an optical scanning system and includes two light sources (e.g., a semiconductor laser, a semiconductor laser array, a multi-beam light source, or the like), a coupling optical system, a shared optical deflector (e.g., a polygon mirror), and two scanning-image forming optical systems. The exposure devices 4 expose the photoconductive drums 2Y, 2M, 2C, and 2K according to yellow, magenta, cyan, and black image data, respectively, thus forming electrostatic latent images.

The photoconductive drums 2Y, 2M, 2C, and 2K of the image forming devices 1Y, 1M, 1C, and 1K are surrounded by chargers 3Y, 3M, 3C, and 3K, developing devices 5Y, 5M, 5C, and 5K, and photoconductive drum cleaners 7Y, 7M, 7C, and 7K, respectively. The chargers 3Y, 3M, 3C, and 3K uniformly charge the photoconductive drums 2Y, 2M, 2C, and 2K, respectively, before the exposure devices 4 expose the photoconductive drums 2Y, 2M, 2C, and 2K. The developing devices 5Y, 5M, 5C, and 5K develop the electrostatic latent images formed by the exposure devices 4 with yellow, magenta, cyan, and black toners, respectively. The photoconductive drum cleaners 7Y, 7M, 7C, and 7K remove residual toner remaining on the photoconductive drums 2Y, 2M, 2C, and 2K, respectively, that is failed to be transferred onto the intermediate transfer belt 10.

At primary transfer positions where the yellow, magenta, cyan, and black toner images are transferred from the photoconductive drums 2Y, 2M, 2C, and 2K onto the intermediate transfer belt 10 are primary transfer rollers 6Y, 6M, 6C, and 6K serving as primary transferors that are disposed opposite the photoconductive drums 2Y, 2M, 2C, and 2K, respectively, via the intermediate transfer belt 10.

The support roller 14, that is, one of the plurality of support rollers supporting the intermediate transfer belt 10, is a driving roller that drives and rotates the intermediate transfer belt 10. The support roller 14 is coupled to a motor through a driving force transmitting mechanism (e.g., a gear, a pulley, and a belt).

In order to form a monochrome image, that is, a black toner image, on the intermediate transfer belt 10, a moving mechanism moves the support rollers 15 and 13 other than the support roller 14 serving as the driving roller, thus separating the photoconductive drums 2Y, 2M, and 2C used for forming the yellow, magenta, and cyan toner images, respectively, from the intermediate transfer belt 10.

A secondary transfer device 22 is disposed opposite the tandem image former 20 via the intermediate transfer belt 10. The secondary transfer device 22 includes a secondary transfer roller 18 that presses against the support roller 16 via the intermediate transfer belt 10, forming a transfer electric field that applies a transfer bias at a secondary transfer position. Thus, the secondary transfer device 22 transfers the yellow, magenta, cyan, and black toner images formed on the intermediate transfer belt 10 onto a sheet S serving as a recording medium, thus forming a color toner image on the sheet S.

The fixing device 12 is disposed downstream from the secondary transfer device 22 in the conveyance direction D of the sheet S. The fixing device 12 fixes the color toner image transferred onto the sheet S thereon.

According to this embodiment, the fixing device 12 includes a fixing rotator 28 (e.g., a fixing roller) serving as a fixing member and a pressure rotator 30 (e.g., a pressure roller) serving as a pressure member. The pressure rotator 30 is pressed against the fixing rotator 28 to form a nip N therebetween. A heater (e.g., a heater, a lamp, or an induction heater employing an electromagnetic induction heating system) is disposed inside or outside at least one of the fixing rotator 28 and the pressure rotator 30.

A conveying belt 24 supported by two rollers 23 conveys the sheet S transferred with the color toner image by the secondary transfer device 22 to the fixing device 12. The conveying belt 24 may be replaced by a stationary guide, a conveying roller, or the like.

The image forming apparatus 100T further includes a sheet reversing device 39 that is disposed below the secondary transfer device 22 and the fixing device 12 in FIG. 2 and is parallel to the tandem image former 20. The sheet reversing device 39 reverses and conveys the sheet S for duplex printing to form toner images on both sides of the sheet S, respectively.

In the image forming apparatus 100T employing an intermediate transfer system using the intermediate transfer belt 10, while toner moves from the photoconductive drums 2Y, 2M, 2C, and 2K to the intermediate transfer belt 10 and from the intermediate transfer belt 10 to the sheet S, an amount rate of the toner that stains the intermediate transfer belt 10 decreases. Hence, an amount of the toner that stains the sheet S in the image forming apparatus 100T employing the intermediate transfer system is smaller than that in the image forming apparatus 100 depicted in FIG. 1 that employs a direct transfer system. Thus, the intermediate transfer system prevents adhesion of the toner to the fixing rotator 28 advantageously.

When the image forming apparatus 100T according to this embodiment receives image data and therefore receives an image formation starting signal, in the tandem image former 20, a driving motor drives and rotates the support roller 14 that drives and rotates the plurality of support rollers other than the support roller 14, that is, the support rollers 15, 13, and 16, via the intermediate transfer belt 10. The intermediate transfer belt 10 rotates in the rotation direction D10 indicated with the arrow in FIG. 2. Simultaneously, a driving motor rotates the photoconductive drums 2Y, 2M, 2C, and 2K of the image forming devices 1Y, 1M, 1C, and 1K, respectively, counterclockwise in FIG. 2. The chargers 3Y, 3M, 3C, and 3K perform a charging process of charging the photoconductive drums 2Y, 2M, 2C, and 2K, respectively. The exposure devices 4 perform an exposure process of exposing the photoconductive drums 2Y, 2M, 2C, and 2K, forming electrostatic latent images. The developing devices 5Y, 5M, 5C, and 5K perform a developing process of developing the electrostatic latent images into toner images with yellow, magenta, cyan, and black toners, respectively. Thus, monochrome images in yellow, magenta, cyan, and black are formed on the photoconductive drums 2Y, 2M, 2C, and 2K, respectively.

As the intermediate transfer belt 10 rotates, the primary transfer rollers 6Y, 6M, 6C, and 6K successively transfer the monochrome images onto the intermediate transfer belt 10, thus forming a composite color toner image on the intermediate transfer belt 10.

On the other hand, while the composite color toner image is formed as described above, one of sheet feeding rollers 42 inside a sheet feeding table 200 serving as a sheet supply is rotated selectively to pick up and feed a sheet S from one of sheet trays 44 (e.g., paper trays) placed in a multistage inside a paper bank 43. A separating roller 45 separates the sheet S that is picked up from other sheets S one by one and feeds the sheet S to a sheet feeding path 46. Conveying rollers 47 convey and guide the sheet S to a sheet feeding path 48 inside the apparatus body 100*a*. As the sheet S strikes the registration roller pair 49, the registration roller pair 49 halts the sheet S.

Alternatively, a plurality of sheets S may be placed on a bypass tray 51. A sheet feeding roller 50 picks up and feeds a sheet S from the bypass tray 51 toward a conveying roller 52. The conveying roller 52 conveys the sheet S through a sheet feeding path 53 toward the registration roller pair 49.

The conveying belt 24 conveys the sheet S transferred with the composite color toner image to the fixing device 12. The fixing device 12 fixes the composite color toner image on the sheet S under heat and pressure. Thereafter, a switching claw switches a conveyance direction of the sheet S toward an ejecting roller 56 that ejects and stacks the sheet S onto a sheet ejection tray 57. Alternatively, the switching claw switches the conveyance direction of the sheet S toward the sheet reversing device 39 that reverses and guides the sheet S to the sheet feeding path 48 inside the apparatus body 100*a* again. The registration roller pair 49 guides the sheet S to the secondary transfer position where the secondary transfer device 22 transfers another composite color toner image onto a back side of the sheet S. Thereafter, the ejecting roller 56 ejects the sheet S onto the sheet ejection tray 57.

On the other hand, after the toner images are transferred from the photoconductive drums 2Y, 2M, 2C, and 2K onto the intermediate transfer belt 10, the photoconductive drum cleaners 7Y, 7M, 7C, and 7K perform a cleaning process of removing residual toner failed to be transferred onto the intermediate transfer belt 10 and therefore remaining on the photoconductive drums 2Y, 2M, 2C, and 2K therefrom. After the composite color toner image is transferred from the intermediate transfer belt 10 onto the sheet S, the intermediate transfer belt cleaner 17 performs a cleaning process of removing residual toner failed to be transferred onto the sheet S and therefore remaining on the intermediate transfer belt 10 therefrom. After the cleaning processes described above, the image forming apparatus 100T is ready for a next image forming job performed by the tandem image former 20.

A description is provided of a construction of the fixing device 12.

FIG. 3 is a schematic cross-sectional view of the fixing device 12 employing a heating roller system, illustrating one example of the fixing device 12 incorporated in the image forming apparatus 100 or 100T according to an embodiment of the present disclosure.

As illustrated in FIG. 3, the fixing device 12 includes the fixing rotator 28 (e.g., a fixing roller) serving as a rotator or a fixing member and the pressure rotator 30 (e.g., a pressure roller) serving as a rotator or a pressure member. The pressure rotator 30 and the fixing rotator 28 form the nip N therebetween.

The fixing rotator 28 that rotates in a rotation direction D28 includes a cored bar and a release layer disposed on an outer circumferential surface of the cored bar. The cored bar is made of metal such as stainless steel and aluminum. The release layer facilitates separation of a sheet S and toner of a toner image T from the fixing rotator 28.

The release layer of the fixing rotator 28 is preferably made of a material that is heat resistant and has a decreased surface energy. For example, the release layer is a heat resistant tube made of silicone resin, fluororesin, or polymeric resin such as polytetrafluoroethylene (PTFE), tetrafluoroethylene-perfluoroalkylvinylether copolymer (PFA), and tetrafluoroethylene-hexafluoropropylene copolymer (FEP).

Further, in order to ensure abrasion resistance, the release layer serving as a surface layer is preferably added with an abrasion resistant additive such as carbon and silicon carbide (SiC). If the abrasion resistant additive in 3 percent by mass or more is added, the abrasion resistant additive attains sufficient abrasion resistance. Conversely, if the abrasion resistant additive in 20 percent by mass or more is added, the abrasion resistant additive may be exposed on a surface of the fixing rotator 28 with an increased exposure rate, degrading separation of toner from the fixing rotator 28. Hence, the abrasion resistant additive in about percent by mass is preferably added.

A heat source 33 serving as a heater is disposed inside the cored bar of the fixing rotator 28. The heat source 33 accelerates temperature increase of the fixing rotator 28. In an example illustrated in FIG. 3, the heat source 33 is a halogen heater. Alternatively, the heat source 33 may be an induction heater, a laminated heat generator, or the like, for example.

The pressure rotator 30 rotates in a rotation direction D30 and includes a cored bar, an elastic layer, and a release layer. The cored bar is made of metal such as stainless steel and aluminum. The elastic layer is disposed on an outer circumferential surface of the cored bar and has an appropriate thickness. The release layer serves as a surface layer.

For example, the elastic layer is made of a heat resistant elastic material such as fluororubber and silicone rubber.

The release layer is made of fluororesin or the like, like the fixing rotator 28.

A resilient member such as a spring presses the pressure rotator 30 against the fixing rotator 28. As the resilient member deforms the elastic layer of the pressure rotator 30 elastically at a pressurizing position, the fixing rotator 28 and the pressure rotator 30 form the nip N therebetween where the fixing rotator 28 and the pressure rotator 30 press and heat toner of the toner image T on the sheet S for a predetermined time.

A separation claw 34 that peels the sheet S bearing the fixed toner image T off the fixing rotator 28 is disposed downstream from the nip N in the conveyance direction D in which the sheet S is conveyed. A tip of the separation claw 34 is disposed opposite the fixing rotator 28. A plurality of separation claws 34 is arranged in an axial direction of the fixing rotator 28 as needed.

The separation claw 34 is preferably made of a material that suppresses adhesion of toner thereto and facilitates sliding of the separation claw 34 over the fixing rotator 28. A surface of the separation claw 34 is preferably coated with polymeric resin such as PTFE, PFA, and FEP.

In order to control the heat source 33, a temperature sensor 36 such as a thermistor detects a temperature of the fixing rotator 28. Based on the temperature detected by the temperature sensor 36, a heating controller 35 preferably controls a temperature of the heat source 33 through a power supply 37.

The heating controller 35 determines a preset fixing temperature of the fixing device 12 based on a viscoelasticity of toner and a result of a fixing property test.

A description is provided of a construction of a comparative image forming apparatus (e.g., a printer).

The comparative image forming apparatus employs a cleaning method to remove a toner stain adhered to a fixing rotator.

The cleaning method removes paper dust and the like adhered to a roller and the like disposed inside an apparatus body of the comparative image forming apparatus with a cleaning sheet that passes through the apparatus body. The cleaning method controls a temperature of a fixing device incorporated in the comparative image forming apparatus to be lower than a regular preset temperature, not higher than a temperature that changes a property of an adhesive of the cleaning sheet, and not lower than a temperature at which toner remelts.

The cleaning method employs the cleaning sheet that is exclusively used for cleaning and therefore treated with processing for collecting the toner stain, thus attaining improved cleaning performance. However, the cleaning sheet exclusively used for cleaning may impose increased costs on a user who purchases and stores the cleaning sheet. Therefore, the user may not use the cleaning sheet.

Instead of the cleaning method using the cleaning sheet exclusively used for cleaning, the comparative image forming apparatus may employ another cleaning method that uses a printed recording medium (e.g., a sheet). However, a wax component contained in toner may render it difficult to remove the toner stain adhered to the fixing rotator.

Additionally, when printing is performed on a recording medium with the fixing rotator adhered with the toner stain, voids or the like may appear on a toner image formed on the recording medium, hindering formation of a desired toner image. When cleaning is performed with the recording medium printed with the faulty toner image, the recording medium may not remove the toner stain from the fixing rotator.

A description is provided of a cleaning mode performed by the image forming apparatuses 100 and 100T depicted in FIGS. 1 and 2, respectively.

The image forming apparatuses 100 and 100T having the constructions described above, respectively, provide the cleaning mode that removes a foreign substance (e.g., a toner stain and paper dust) from the surface of the fixing rotator 28 by passing a sheet S fixed with a toner image T through the nip N.

The following describes the cleaning mode performed by the image forming apparatuses 100 and 100T according to an embodiment of the present disclosure.

Figure 4A:
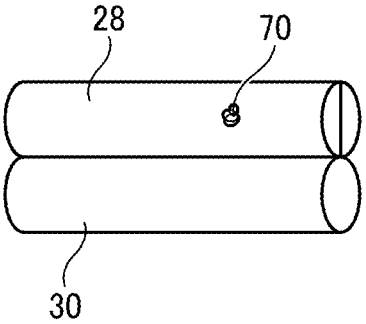
FIG. 4A is a perspective view of a fixing rotator and a pressure rotator incorporated in the fixing device depicted in FIG. 3, illustrating a toner stain adhered to the fixing rotator.
Figure 4B:
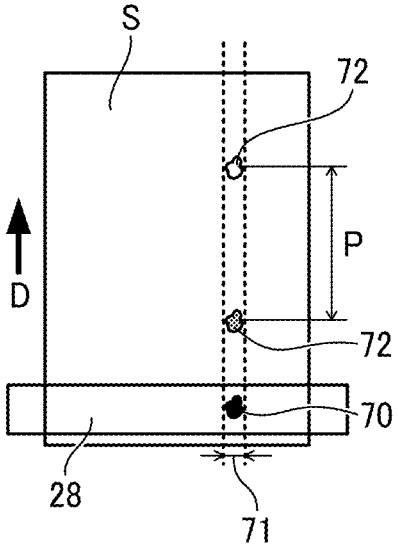
FIG. 4B is a diagram of the fixing rotator depicted in FIG. 4A, illustrating fixing failure caused by the toner stain.

FIGS. 4A and 4B illustrate the fixing rotator 28 in a state in which a toner stain 70 is adhered to the surface of the fixing rotator 28.

FIG. 4A is a perspective view of the fixing rotator 28 and the pressure rotator 30, illustrating the toner stain 70 adhered to the fixing rotator 28. FIG. 4B is a diagram of the fixing rotator 28 and a sheet S, illustrating fixing failure that occurs when the fixing rotator 28 depicted in FIG. 4A is used.

If the toner stain 70 is adhered to the surface of the fixing rotator 28, fixing performance may degrade on an adhesion portion of the fixing rotator 28, that is adhered with the toner stain 70. For example, as illustrated in FIG. 4B, a toner image conveyed over a stained region 71 on the fixing rotator 28, that bears the toner stain 70, may not be fixed on the sheet S sufficiently. Accordingly, offset images 72 may appear on the sheet S with a pitch P between the offset images 72, that is equivalent to a circumference of the fixing rotator 28 that rotates.

As a technology for removing the toner stain 70 from the surface of the fixing rotator 28, a method for removing the toner stain 70 by passing a cleaning sheet including an adhesive layer or a recording medium, serving as a cleaning sheet, fixed with a toner image through the nip N is provided.

If the recording medium fixed with the toner image is used as the cleaning sheet, a temperature of the fixing rotator 28 during cleaning is preferably lower than a regular preset fixing temperature.

Figure 5:
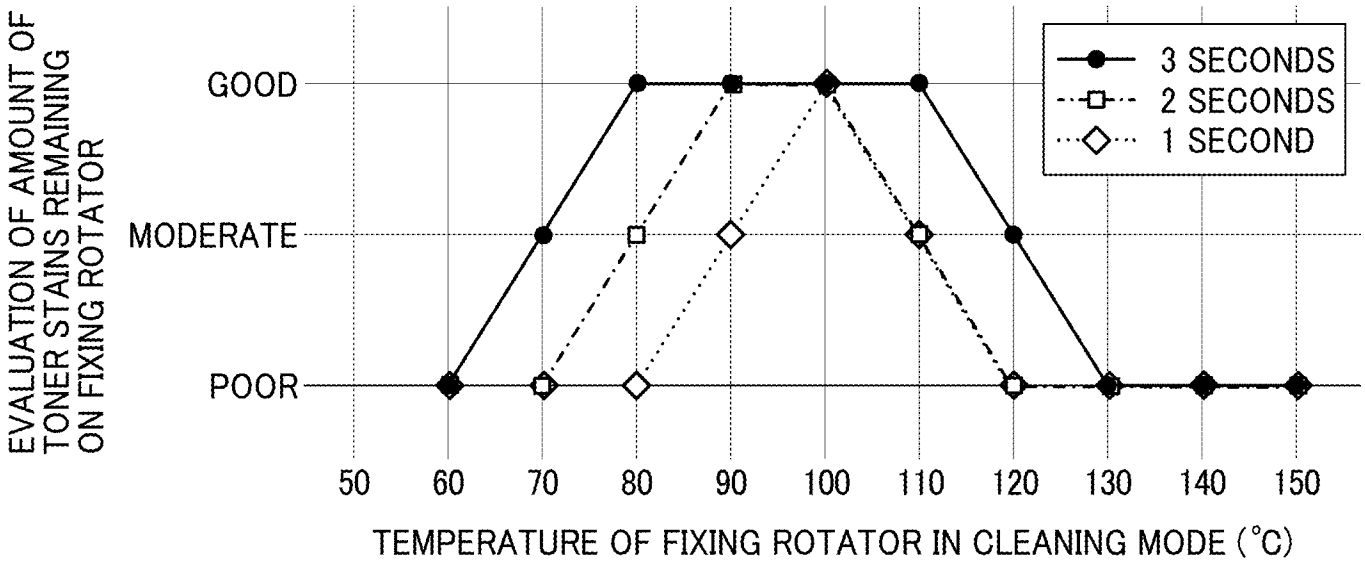
FIG. 5 is a graph illustrating a relation between a temperature of the fixing rotator depicted in FIG. 4A in a cleaning mode for cleaning the fixing rotator and evaluation of an amount of toner stains remaining on the fixing rotator.

FIG. 5 is a graph illustrating a result of an examination of the temperature of the fixing rotator 28 during cleaning.

FIG. 5 illustrates an example of an evaluation of an amount of toner stains remaining on the fixing rotator 28 after a recording medium, that is, plain paper, printed with a solid toner image is used as a cleaning sheet to clean the fixing rotator 28.

Toner designed to be fixed on the recording medium at 150 degrees Celsius to print the cleaning sheet is used. During cleaning, in order to improve cleaning performance, the cleaning sheet is halted in a state in which the cleaning sheet is sandwiched between the fixing rotator 28 and the pressure rotator 30 at the nip N. Whenever the cleaning sheet is halted for one second, two seconds, and three seconds, respectively, an evaluation is performed at every preset fixing temperature of the fixing rotator 28, that varies every 10 degrees Celsius from 60 degrees Celsius to 150 degrees Celsius.

A small amount of the toner stains remaining on the surface of the fixing rotator 28 after cleaning is evaluated as "good". A slightly great amount of the toner stains remaining on the surface of the fixing rotator 28 after cleaning is evaluated as "moderate". A great amount of the toner stains remaining on the surface of the fixing rotator 28 after cleaning is evaluated as "poor".

When the fixing temperature, that is, the temperature of the fixing rotator 28, exceeds 110 degrees Celsius, a wax component contained in toner starts separating out. During regular printing, the wax component advantageously prevents the recording medium from being wound around the fixing rotator 28. Conversely, during cleaning, the wax component may degrade an adhesive force of toner, that adheres the toner image on the cleaning sheet to the surface of the fixing rotator 28, disadvantageously decreasing an amount of the toner stains that move to the cleaning sheet. Hence, the fixing temperature, that is, the temperature of the fixing rotator 28, during cleaning is preferably lower than 110 degrees Celsius. The example of the evaluation illustrated in FIG. 5 indicates that the fixing temperature in a range of from 80 degrees Celsius to 110 degrees Celsius achieves proper cleaning performance.

On the other hand, a resin component contained in toner melts under a predetermined heat amount or more. If the fixing temperature lowers to prevent the wax component from separating out, the resin component may not melt due to shortage of the heat amount, hindering generation of the adhesive force and achievement of the proper cleaning performance. To address this circumstance, the heat amount is preferably sufficient under an increased heating time without increasing the fixing temperature. The example of the evaluation depicted in FIG. 5 indicates that the proper cleaning performance is achieved by interrupting rotation of the fixing rotator 28, that is, conveyance of the cleaning sheet, for three seconds in a state in which the cleaning sheet is sandwiched between the fixing rotator 28 and the pressure rotator 30 at the nip N.

After the cleaning sheet is halted, the cleaning sheet sandwiched between the fixing rotator 28 and the pressure rotator 30 at the nip N resumes being conveyed. The cleaning sheet is preferably conveyed for a length for which the cleaning sheet contacts the fixing rotator 28 when the cleaning sheet is halted, that is, a length of the nip N in the rotation direction D28 of the fixing rotator 28 at maximum. Accordingly, the cleaning sheet cleans the fixing rotator 28 entirely in a circumferential direction thereof.

According to the result of the evaluation described above, the image forming apparatuses 100 and 100T according to this embodiment preferably perform the cleaning mode in which an interrupting operation and a conveying operation are repeated for a predetermined number of times. In the interrupting operation, conveyance of the cleaning sheet, that is, a recording medium bearing a toner image as a cleaning image, stops in a state in which the cleaning sheet is sandwiched between the fixing rotator 28 and the pressure rotator 30 at the nip N. In the conveying operation, the cleaning sheet is conveyed for the length equivalent to the length of the nip N in the rotation direction D28 of the fixing rotator 28.

A temperature of the fixing rotator 28 in the cleaning mode is preferably lower than a preset fixing temperature at which the fixing rotator 28 fixes a toner image (e.g., the toner image T) on a recording medium (e.g., the sheet S).

The predetermined number of times for which the interrupting operation and the conveying operation are repeated is preferably not smaller than a number obtained by rounding up a value obtained by dividing the circumference of the fixing rotator 28 by the length of the nip N in the circumferential direction of the fixing rotator 28 into an integer.

Figure 6:
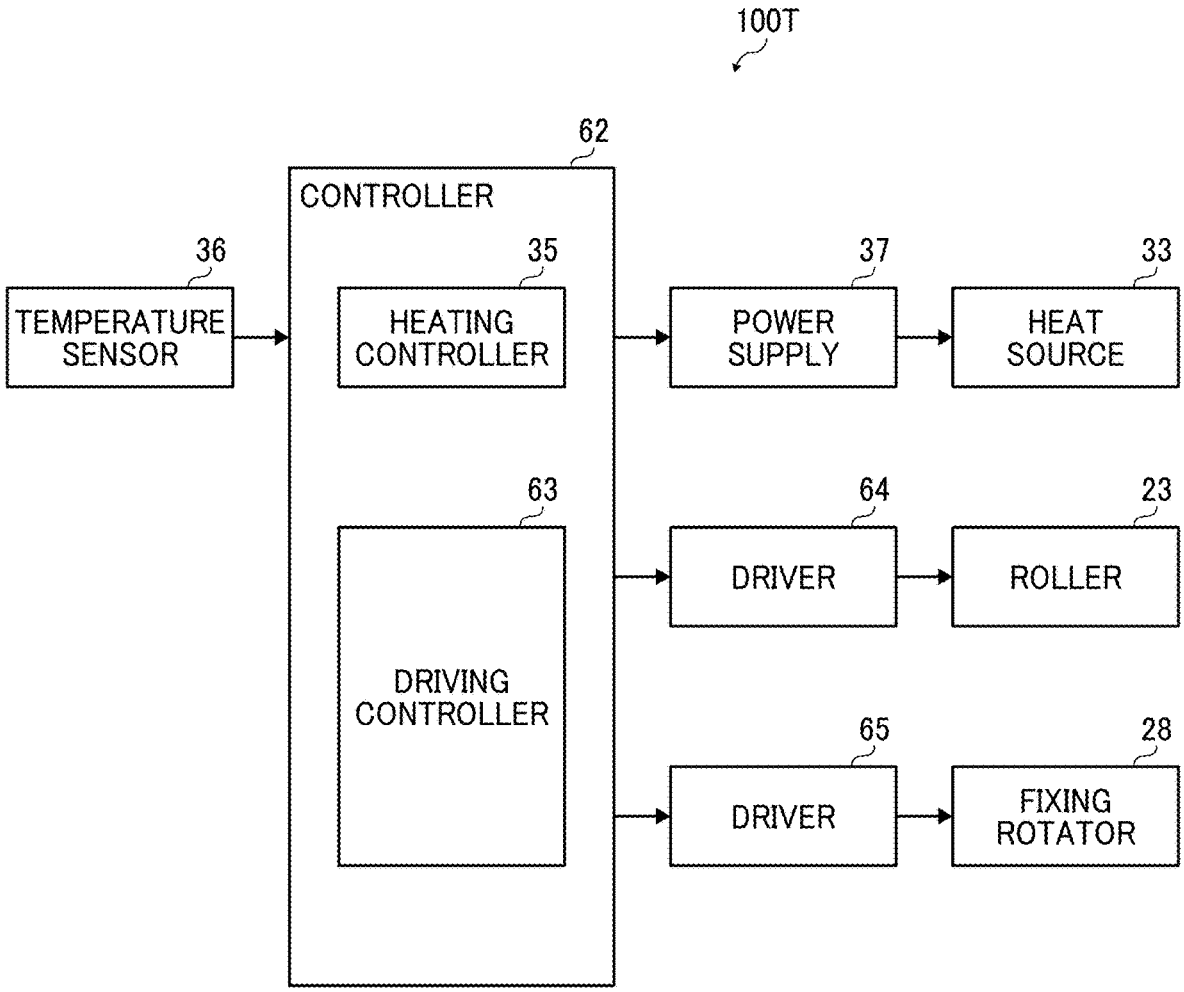
FIG. 6 is a block diagram of the image forming apparatus depicted in FIG. 2.
Figure 7:
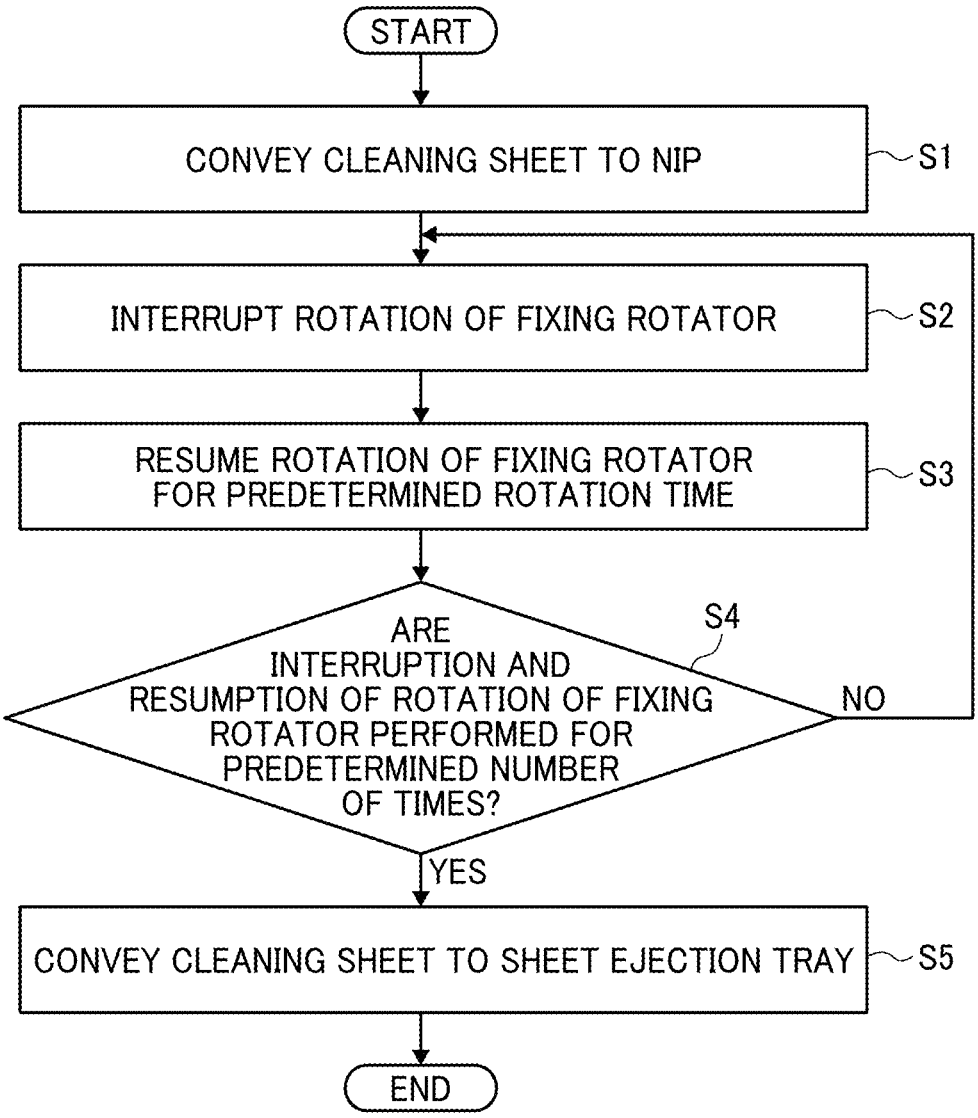
FIG. 7 is a flowchart illustrating control processes to control the cleaning mode depicted in FIG. 5.

FIG. 6 is a block diagram of the image forming apparatus 100T. FIG. 7 is a flowchart of a sequence of processes of the cleaning mode performed by the image forming apparatus 100T according to an embodiment of the present disclosure as one example. The block diagram depicted in FIG. 6 and the flowchart depicted in FIG. 7 are also applicable to the image forming apparatus 100 depicted in FIG. 1.

A controller 62 including a central processing unit (CPU), a random-access memory (RAM), and a read-only memory (ROM) determines that a temperature of the fixing rotator 28 is lower than the preset fixing temperature at which the fixing rotator 28 fixes a toner image (e.g., the toner image T) on a recording medium (e.g., the sheet S) during regular printing. Thereafter, the controller 62 starts the cleaning mode.

As illustrated in the flowchart depicted in FIG. 7, in step S1, a driving controller 63 of the controller 62 controls a driver 64 (e.g., a motor) to drive and rotate the roller 23 so that the roller 23 drives and rotates the conveying belt 24 to convey a cleaning sheet bearing a cleaning image produced by fixing a toner image on a recording medium to the nip N.

In step S2, when the cleaning image on the cleaning sheet comes into contact with the fixing rotator 28 at the nip N, the driving controller 63 controls a driver 65 (e.g., a motor) to interrupt rotation of the fixing rotator 28 for a predetermined interruption time, thus interrupting conveyance of the cleaning sheet. The predetermined interruption time in step S2 is properly selected within a range that improves an adhesive force of the cleaning image, for example, three seconds.

During the predetermined interruption time, a toner stain on the surface of the fixing rotator 28 in a contact region that contacts the cleaning image moves to the cleaning image.

After the predetermined interruption time elapses, the driving controller 63 controls the driver 65 to resume rotation of the fixing rotator 28 for a predetermined rotation time, thus resuming conveyance of the cleaning sheet in step S3. The predetermined rotation time of the fixing rotator 28 in step S3 defines a time taken to convey the cleaning sheet for the length equivalent to the length of the nip N in the rotation direction D28 of the fixing rotator 28. The predetermined rotation time is selected properly based on the length of the nip N in the rotation direction D28 of the fixing rotator 28. As one example, the predetermined rotation time is 500 milliseconds according to this embodiment.

In step S4, the controller 62 determines whether or not steps S2 and S3 are performed for a predetermined number of times. If the controller 62 determines that steps S2 and S3 are performed for a number of times smaller than the predetermined number of times, the controller 62 repeats step S2. Conversely, if the controller 62 determines that steps S2 and S3 are performed for the predetermined number of times, the driving controller 63 of the controller 62 controls the driver 65 to rotate the fixing rotator 28 so as to convey the cleaning sheet to the sheet ejection tray 57 in step S5, thus finishing the cleaning mode.

The predetermined number of times based on which the controller 62 performs determination in step S4 is properly set within a range in which the cleaning sheet cleans the fixing rotator 28 entirely in the circumferential direction thereof based on the circumference of the fixing rotator 28, the length of the nip N in the circumferential direction of the fixing rotator 28, the predetermined rotation time of the fixing rotator 28 in step S3, and the like. As one example, according to this embodiment, the predetermined number of times is 15 times.

In the cleaning mode, a conveyance direction in which the cleaning sheet is conveyed is not limited to one direction. For example, the conveying operation in the cleaning mode may include a forward direction conveying operation and a backward direction conveying operation. In the forward direction conveying operation, the cleaning sheet is conveyed in a regular conveyance direction (e.g., the conveyance direction D) in a state in which the fixing rotator 28 and the pressure rotator 30 sandwich the cleaning sheet at the nip N. In the backward direction conveying operation, the cleaning sheet is conveyed in an opposite conveyance direction opposite to the regular conveyance direction. Thus, the cleaning image repeatedly contacts an identical region on the fixing rotator 28 at the nip N, improving cleaning performance.

A time when the backward direction conveying operation is performed may be after the entire cleaning image is conveyed in a forward direction or after a part of the cleaning image is conveyed in the forward direction.

The image forming apparatuses 100 and 100T according to this embodiment preferably include a conveyer 66 depicted in FIG. 2 that is disposed downstream from the nip N in the conveyance direction D of the cleaning sheet. In the cleaning mode, when the controller 62 interrupts conveyance of the cleaning sheet, the conveyer 66 supports a projecting portion of the cleaning sheet, that projects downstream from the nip N in the conveyance direction D, preventing the projection portion of the cleaning sheet from being wound around the fixing rotator 28.

In the image forming apparatuses 100 and 100T according to this embodiment, when the controller 62 interrupts and resumes rotation of the fixing rotator 28 repeatedly in the cleaning mode, a rotation time of a downstream roller (e.g., the conveyer 66 depicted in FIG. 2) disposed downstream from the fixing device 12 in the conveyance direction D is preferably longer than a rotation time of the fixing rotator 28. Accordingly, the projecting portion of the cleaning sheet, that projects downstream from the nip N in the conveyance direction D, is exerted with a pulling force from the downstream roller and therefore is not wound around the fixing rotator 28.

The image forming apparatuses 100 and 100T according to the embodiments of the present disclosure further provide a cleaning sheet creation mode that creates a cleaning sheet by fixing a toner image, to be formed into a cleaning image, on a recording medium. In the cleaning mode, the cleaning sheet bearing the cleaning image passes through the nip N in a state in which the cleaning image is disposed opposite the fixing rotator 28 and in which the cleaning sheet is oriented in a different orientation different from an orientation in which the cleaning sheet is oriented while the toner image is fixed on the recording medium to create the cleaning sheet in the cleaning sheet creation mode.

The following describes creation of the cleaning sheet and conveyance of the cleaning sheet that is created.

A description is provided of the cleaning sheet creation mode.

Figure 8:
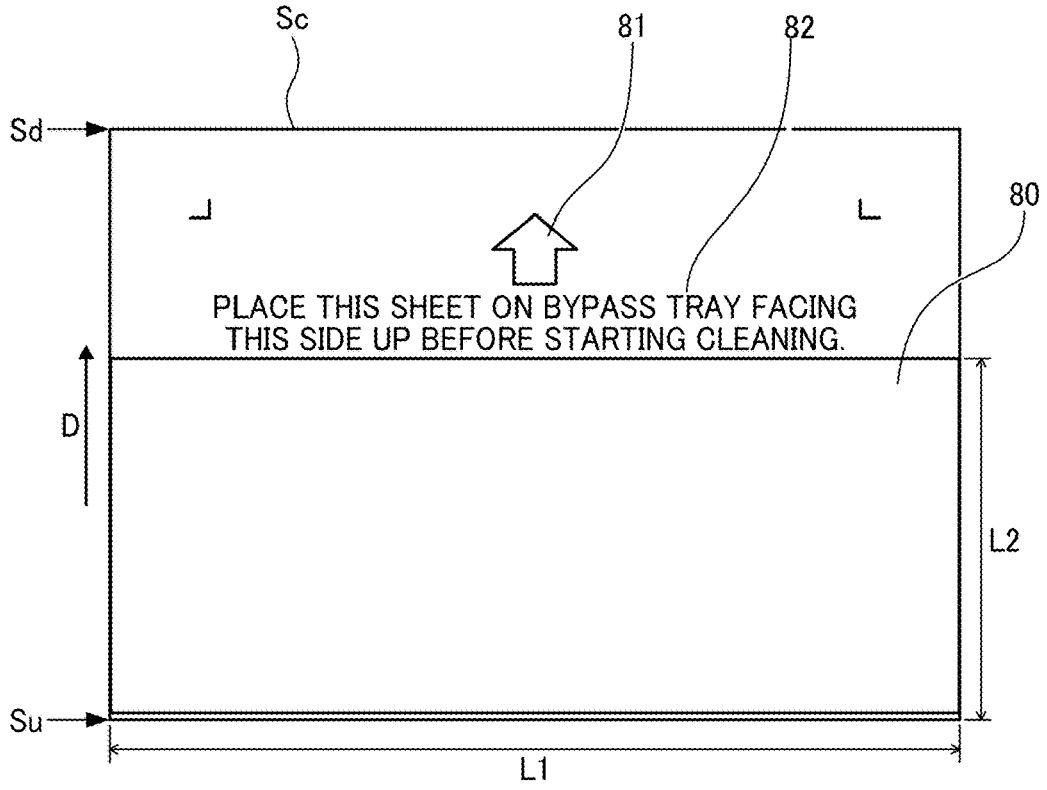
FIG. 8 is a diagram of one example of a cleaning sheet that is produced by performing a cleaning sheet creation mode and is used in the cleaning mode depicted in FIG. 7.

FIG. 8 illustrates one example of a cleaning sheet Sc produced by performing the cleaning sheet creation mode.

The cleaning sheet Sc is produced by fixing a toner image, to be formed into a cleaning image 80, on a recording medium used for regular printing.

As illustrated in FIG. 8, the cleaning sheet Sc includes a downstream edge Sd and an upstream edge Su in the conveyance direction D in which the recording medium is conveyed while the toner image is fixed on the recording medium to produce the cleaning sheet Sc bearing the cleaning image 80.

The cleaning sheet Sc is preferably formed with an image 81, serving as a setting orientation image, that indicates a setting orientation in which the user sets or orients the cleaning sheet Sc on the bypass tray 51 depicted in FIG. 2 to cause the image forming apparatus 100 or 100T to perform the cleaning mode, in addition to the cleaning image 80. The cleaning sheet Sc is further formed with an image 82 (e.g., a character string), serving as an instruction image, that indicates an instruction and a warning to the user who sets the cleaning sheet Sc in the image forming apparatus 100 or 100T.

The image forming apparatuses 100 and 100T provide a first embodiment in which, in the cleaning mode, a sheet feeding mechanism (e.g., the conveying roller 52) or the like incorporated in the image forming apparatus 100 or 100T causes the cleaning sheet Sc bearing the cleaning image 80 to pass through the nip N in a state in which the cleaning image 80 is disposed opposite the fixing rotator 28 and in which the cleaning sheet Sc is oriented in a different orientation different from an orientation in which the cleaning sheet Sc is oriented while a toner image is fixed on a recording medium to create the cleaning sheet Sc in the cleaning sheet creation mode. The image forming apparatuses 100 and 100T further provide a second embodiment in which, as the user sets the cleaning sheet Sc properly, the cleaning sheet Sc bearing the cleaning image 80 passes through the nip N in a state in which the cleaning image 80 is disposed opposite the fixing rotator 28 and in which the cleaning sheet Sc is oriented in a different orientation different from an orientation in which the cleaning sheet Sc is oriented while a toner image is fixed on a recording medium to create the cleaning sheet Sc in the cleaning sheet creation mode.

Since the images 81 and 82 are formed on the cleaning sheet Sc, the cleaning sheet Sc is conveyed properly in the second embodiment.

The cleaning image 80 is preferably a solid image having a maximum toner adhesion amount per unit area on the cleaning sheet Sc. The cleaning image 80 as the solid image maximizes cleaning performance in a single cleaning.

The cleaning image 80 is preferably formed on the cleaning sheet Sc such that a margin having a minimum size is created on each lateral end of the cleaning sheet Sc in a direction perpendicular to the conveyance direction D of the cleaning sheet Sc. The direction perpendicular to the conveyance direction D is a longitudinal direction L1 in an example illustrated in FIG. 8. The cleaning image 80 is formed even on the margins on the cleaning sheet Sc in the longitudinal direction L1 where no image is formed during regular printing. Accordingly, the cleaning sheet Sc removes toner stains from the surface of the fixing rotator 28 thoroughly, preventing the toner stains from being transferred from the fixing rotator 28 onto margins on a sheet S in the longitudinal direction L1.

A length of the cleaning image 80 in the conveyance direction D of the cleaning sheet Sc is preferably not shorter than the circumference of the fixing rotator 28. The length in the conveyance direction D defines the length in a short direction L2 in the example illustrated in FIG. 8. The circumference of the fixing rotator 28 is calculated by multiplying a diameter of the fixing rotator 28 by Pi in an embodiment in which the fixing rotator 28 is a fixing roller.

Accordingly, the cleaning image 80 contacts an outer circumferential surface of the fixing rotator 28 at least once, thus cleaning the outer circumferential surface of the fixing rotator 28 thoroughly.

Figure 9:
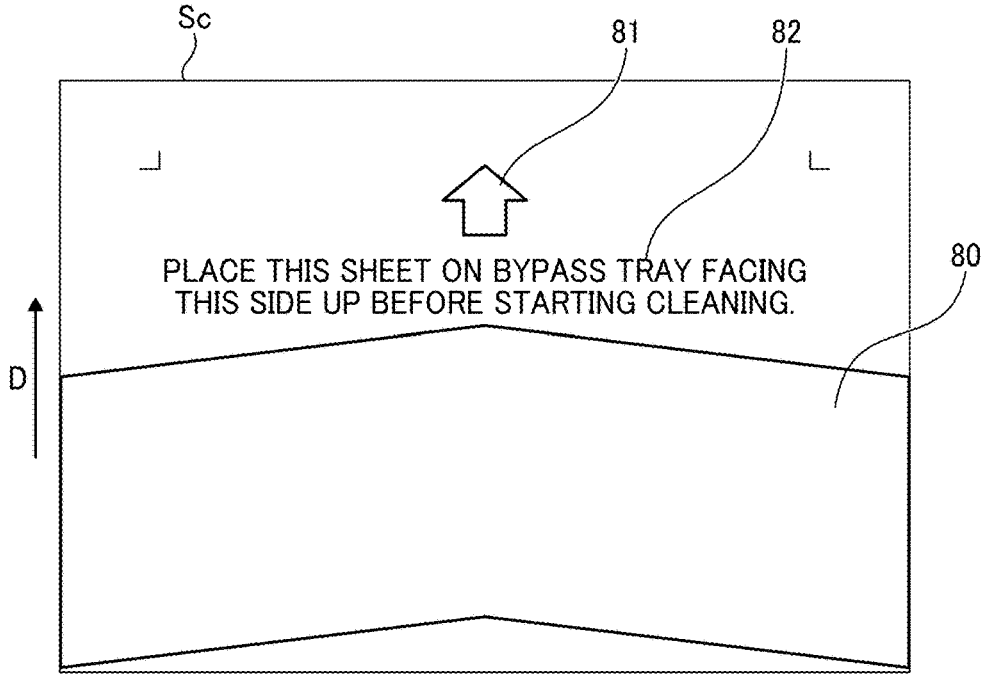
FIG. 9 is a diagram of another example of the cleaning sheet depicted in FIG. 8.

The cleaning image 80 may have a shape other than that illustrated in the example in FIG. 8. For example, the cleaning image 80 may have a shape illustrated in FIG. 9. In this case also, the cleaning image 80 is preferably formed on the cleaning sheet Sc such that a margin having a minimum size is created on each lateral end of the cleaning sheet Sc in the direction perpendicular to the conveyance direction D of the cleaning sheet Sc. The length of the cleaning image 80 in the conveyance direction D of the cleaning sheet Sc is preferably not shorter than the circumference of the fixing rotator 28.

A description is provided of orientations of the cleaning sheet Sc.

Referring to FIGS. 10A, 10B, 11A, 11B, 11C, and 11D, a description is provided of the orientations of the cleaning sheet Sc conveyed in the conveyance direction D in the cleaning mode performed by the image forming apparatuses 100 and 100T according to an embodiment of the present disclosure.

FIGS. 10A, 10B, 11A, 11B, 11C, and 11D illustrate an example of conveyance of the cleaning sheet Sc performed by the image forming apparatuses 100 and 100T according to the embodiment of the present disclosure. FIGS. 12A, 12B, 13A, 13B, 13C, and 13D illustrate a comparative example of conveyance of a cleaning sheet ScC.

Figure 10A:
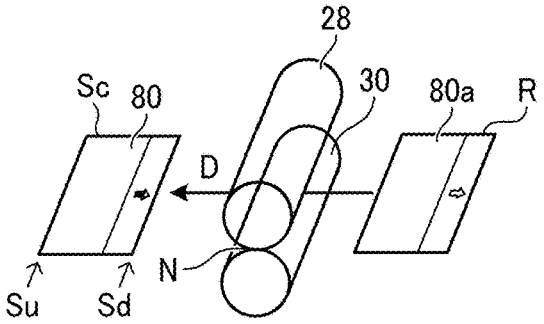
FIG. 10A is a perspective view of the fixing rotator and the pressure rotator depicted in FIG. 4A, illustrating an orientation of a recording medium conveyed in a conveyance direction in the cleaning sheet creation mode.
Figure 10B:
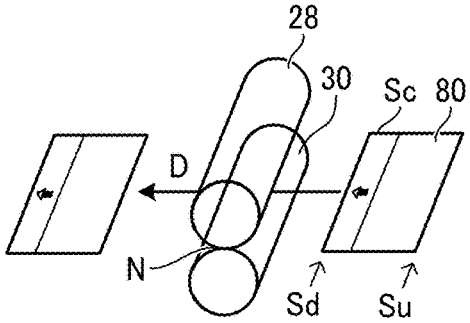
FIG. 10B is a perspective view of the fixing rotator and the pressure rotator depicted in FIG. 4A, illustrating an orientation of a cleaning sheet conveyed in the conveyance direction in the cleaning mode.

As illustrated in FIG. 10B, in the cleaning mode, the cleaning sheet Sc bearing the cleaning image 80 passes through the nip N such that the cleaning image 80 is disposed opposite the fixing rotator 28 and that the cleaning sheet Sc is oriented in a different orientation different from an orientation in which the cleaning sheet Sc is oriented while an unfixed toner image 80*a* is fixed on a recording medium R in the cleaning sheet creation mode depicted in FIG. 10A. For example, in the cleaning mode, the cleaning sheet Sc bearing the cleaning image 80 preferably passes through the nip N such that the cleaning image 80 is disposed opposite the fixing rotator 28 and that the downstream edge Sd of the cleaning sheet Sc in the conveyance direction D when the unfixed toner image 80*a* is fixed on the recording medium R to create the cleaning sheet Sc bearing the cleaning image 80 as illustrated in FIG. 10A serves as an upstream edge of the cleaning sheet Sc in the conveyance direction D as illustrated in FIG. 10B.

FIG. 10A is a perspective view of the fixing rotator 28 and the pressure rotator 30, illustrating an orientation of the recording medium R conveyed in the conveyance direction D in the cleaning sheet creation mode. As illustrated in FIG. 10A, the recording medium R bearing the unfixed toner image 80*a* to be formed into the cleaning image 80 is conveyed in the conveyance direction D. As the recording medium R passes through the nip N of the fixing device 12, the fixing rotator 28 and the pressure rotator 30 fix the unfixed toner image 80*a* on the recording medium R, producing the cleaning sheet Sc bearing the cleaning image 80. The cleaning sheet Sc includes the downstream edge Sd and the upstream edge Su in the conveyance direction D in which the recording medium R is conveyed when the unfixed toner image 80*a* is fixed on the recording medium R to produce the cleaning sheet Sc.

FIG. 10B is a perspective view of the fixing rotator 28 and the pressure rotator 30, illustrating an orientation of the cleaning sheet Sc conveyed in the conveyance direction D in the cleaning mode. As illustrated in FIG. 10B, the cleaning sheet Sc bearing the cleaning image 80 passes through the nip N in the conveyance direction D such that the cleaning image 80 is disposed opposite the fixing rotator 28 and that the downstream edge Sd of the cleaning sheet Sc in the conveyance direction D in the cleaning sheet creation mode depicted in FIG. 10A serves as an upstream edge of the cleaning sheet Sc in the conveyance direction D in the cleaning mode depicted in FIG. 10B. For example, in the cleaning mode depicted in FIG. 10B, the downstream edge Sd of the cleaning sheet Sc in the cleaning sheet creation mode enters the nip N before the upstream edge Su of the cleaning sheet Sc.

Figure 11A:
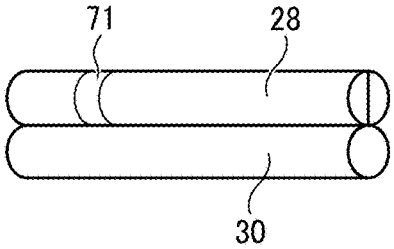
FIG. 11A is a perspective view of the fixing rotator and the pressure rotator depicted in FIG. 4A, illustrating a circumferential region on the fixing rotator, that is adhered with toner stains.

FIGS. 11A, 11B, 11C, and 11D illustrate processes of the cleaning sheet creation mode and the cleaning mode when toner stains adhere to a circumferential region 71 on the fixing rotator 28 depicted in FIG. 11A. The toner stains adhere to at least a part of the circumferential region 71.

Figure 11B:
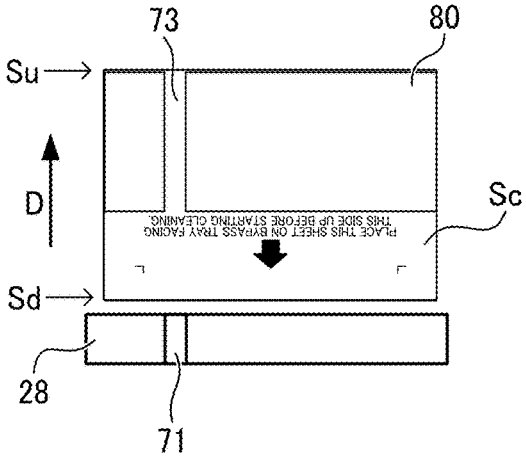
FIG. 11B is a diagram of the fixing rotator depicted in FIG. 11A, illustrating a cleaning sheet created in the cleaning sheet creation mode.

FIG. 11B is a diagram of the fixing rotator 28, illustrating the cleaning sheet Sc produced in the cleaning sheet creation mode. A contact region 73 on the cleaning sheet Sc, that contacts the circumferential region 71 on the fixing rotator 28, suffers from fixing failure caused by the toner stains adhered to the fixing rotator 28. The contact region 73 suffers from voids.

Figure 11C:
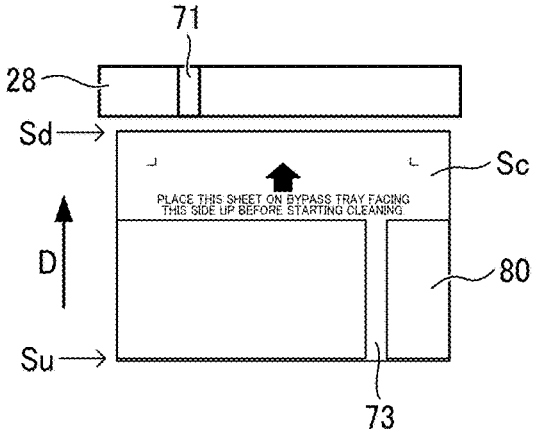
FIG. 11C is a diagram of the fixing rotator depicted in FIG. 11A, illustrating the cleaning sheet conveyed toward the fixing rotator in the cleaning mode.

FIG. 11C is a diagram of the fixing rotator 28, illustrating the orientation of the cleaning sheet Sc in the cleaning mode. In FIG. 11C, the downstream edge Sd of the cleaning sheet Sc in the conveyance direction D in FIG. 11B enters the nip N before the upstream edge Su of the cleaning sheet Sc in the conveyance direction D in FIG. 11B, thus serving as an upstream edge of the cleaning sheet Sc in the conveyance direction D in FIG. 11C. The cleaning image 80 in FIG. 11C is symmetric with the cleaning image 80 in FIG. 11B with respect to the fixing rotator 28 in the conveyance direction D.

Figure 11D:
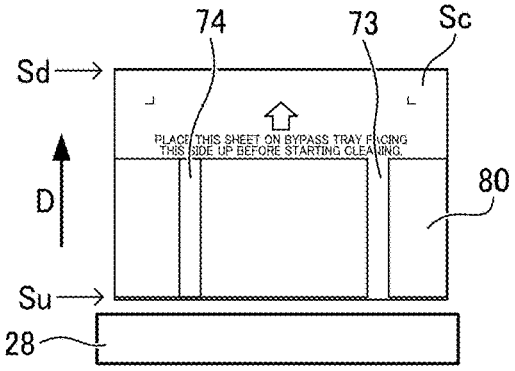
FIG. 11D is a diagram of the fixing rotator depicted in FIG. 11A, illustrating the cleaning sheet having passed over the fixing rotator and having removed the toner stains from the fixing rotator in the cleaning mode.

FIG. 11D is a diagram of the fixing rotator 28 and the cleaning sheet Sc, illustrating the cleaning sheet Sc after the cleaning mode. As the cleaning image 80 having an adhesive force contacts the circumferential region 71 on the fixing rotator 28, that is adhered with the toner stains, the toner stains move to the cleaning image 80. Thus, the cleaning image 80 has a stained region 74 that bears the toner stains moved from the fixing rotator 28.

As described above, in the image forming apparatuses 100 and 100T according to this embodiment, the recording medium R bearing the unfixed toner image 80*a* printed by the image forming apparatus 100 or 100T incorporating the fixing rotator 28 is formed into the cleaning sheet Sc that removes the toner stains adhered to the fixing rotator 28 therefrom. For example, the cleaning sheet Sc produced by the fixing rotator 28 of which surface is adhered with the toner stains removes the toner stains from the fixing rotator 28.

A description is provided of a comparative example of orientations of a recording medium RC and a cleaning sheet ScC.

Figure 12A:
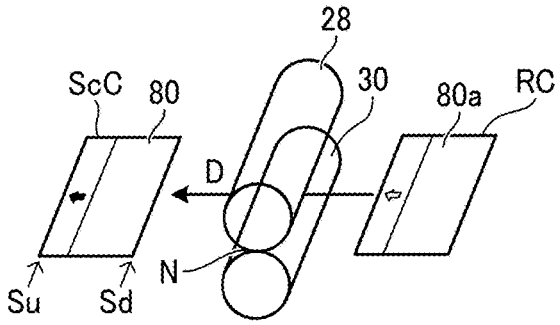
FIG. 12A is a perspective view of the fixing rotator and the pressure rotator depicted in FIG. 4A, illustrating an orientation of a recording medium conveyed in a conveyance direction in a cleaning sheet creation mode according to a comparative example.
Figure 12B:
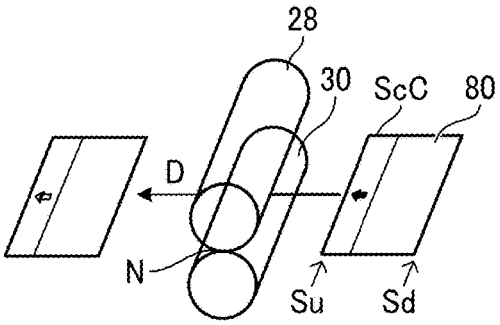
FIG. 12B is a perspective view of the fixing rotator and the pressure rotator depicted in FIG. 4A, illustrating an orientation of a cleaning sheet conveyed in the conveyance direction in a cleaning mode according to the comparative example.

FIGS. 12A and 12B illustrate the orientations of the recording medium RC and the cleaning sheet ScC conveyed in the conveyance direction D in the cleaning sheet creation mode and the cleaning mode, respectively, according to the comparative example. In the cleaning mode depicted in FIG. 12B using the cleaning sheet ScC produced in the cleaning sheet creation mode depicted in FIG. 12A, the cleaning image 80 on the cleaning sheet ScC passes through the nip N in the conveyance direction D with an orientation that is identical to an orientation with which the recording medium RC is conveyed through the nip N in the conveyance direction D to fix the unfixed toner image 80*a* on the recording medium RC such that the cleaning image 80 is disposed opposite the fixing rotator 28.

Figure 13A:
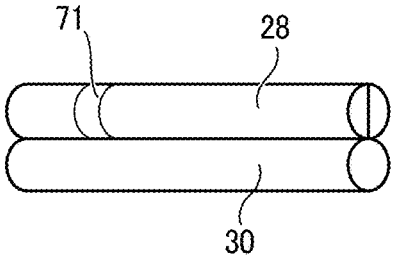
FIG. 13A is a perspective view of the fixing rotator and the pressure rotator depicted in FIG. 12A, illustrating the circumferential region on the fixing rotator, that is adhered with toner stains according to the comparative example.

FIGS. 13A, 13B, 13C, and 13D illustrate processes of the cleaning sheet creation mode and the cleaning mode when toner stains adhere to the circumferential region 71 on the fixing rotator 28 depicted in FIG. 13A. The toner stains adhere to at least a part of the circumferential region 71.

Figure 13B:
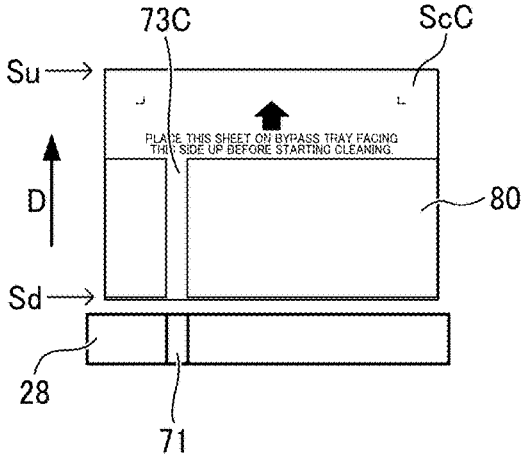
FIG. 13B is a diagram of the fixing rotator depicted in FIG. 13A, illustrating a cleaning sheet conveyed in the cleaning sheet creation mode according to the comparative example.

FIG. 13B is a diagram of the fixing rotator 28, illustrating the cleaning sheet ScC produced in the cleaning sheet creation mode. A contact region 73C on the cleaning sheet ScC, that contacts the circumferential region 71 on the fixing rotator 28, suffers from fixing failure caused by the toner stains adhered to the fixing rotator 28. The contact region 73C suffers from voids.

Figure 13C:
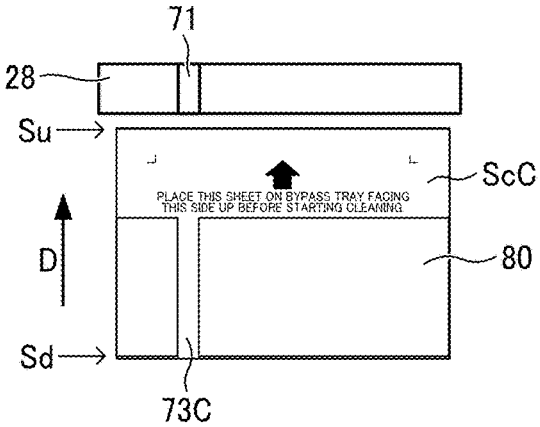
FIG. 13C is a diagram of the fixing rotator depicted in FIG. 13A, illustrating the cleaning sheet conveyed toward the fixing rotator in the cleaning mode according to the comparative example.

FIG. 13C is a diagram of the fixing rotator 28, illustrating the orientation of the cleaning sheet ScC in the cleaning mode. The cleaning sheet ScC is conveyed with an identical orientation in the cleaning sheet creation mode depicted in FIG. 13B and the cleaning mode depicted in FIG. 13C. For example, in FIG. 13C, the upstream edge Su of the cleaning sheet ScC in the conveyance direction D in FIG. 13B enters the nip N before the downstream edge Sd of the cleaning sheet ScC in the conveyance direction D in FIG. 13B, thus serving as an upstream edge of the cleaning sheet ScC in the conveyance direction D both in FIGS. 13B and 13C.

Figure 13D:
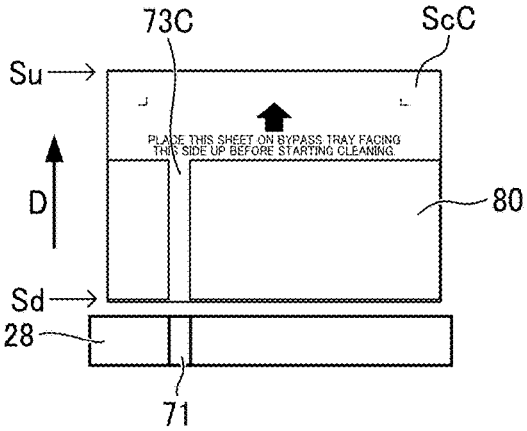
FIG. 13D is a diagram of the fixing rotator depicted in FIG. 13A, illustrating the cleaning sheet having passed over the fixing rotator and not having removed the toner stains from the fixing rotator in the cleaning mode according to the comparative example.

FIG. 13D is a diagram of the fixing rotator 28 and the cleaning sheet ScC, illustrating the cleaning sheet ScC after the cleaning mode. The contact region 73C on the cleaning sheet ScC, that has voids, contacts the circumferential region 71 on the fixing rotator 28, that is adhered with the toner stains. Hence, the cleaning image 80 on the cleaning sheet ScC does not remove the toner stains, causing the toner stains to remain on the fixing rotator 28 and failing to achieve cleaning performance.

A description is provided of a cleaning method for cleaning the fixing rotator 28.

The cleaning method according to an embodiment of the present disclosure is performed by an image forming apparatus (e.g., the image forming apparatuses 100 and 100T) that includes an image forming device (e.g., the image forming devices 1, 1Y, 1M, 1C, and 1K) that forms a toner image (e.g., the unfixed toner image 80*a*) on a recording medium (e.g., the recording medium R) and a fixing device (e.g., the fixing device 12) that fixes the toner image on the recording medium. The fixing device 12 includes the fixing rotator 28 serving as a rotator that rotates and the pressure rotator 30 that is pressed against the fixing rotator 28 to form the nip N therebetween. As the recording medium bearing the toner image is conveyed through the nip N, the fixing rotator 28 and the pressure rotator 30 fix the toner image on the recording medium. The cleaning method performed by the image forming apparatus includes the cleaning mode that removes a foreign substance from the surface of the fixing rotator 28 while the recording medium fixed with the toner image is conveyed through the nip N.

The cleaning method according to the embodiment of the present disclosure further includes the cleaning sheet creation mode that creates the cleaning sheet Sc bearing the cleaning image 80 by fixing the toner image on the recording medium. In the cleaning mode, the cleaning sheet Sc passes through the nip N such that the cleaning image 80 is disposed opposite the fixing rotator 28 and that the cleaning sheet Sc is oriented in a different orientation different from an orientation in which the cleaning sheet Sc is oriented while the unfixed toner image 80*a* is fixed on the recording medium R in the cleaning sheet creation mode.

In the cleaning mode, the cleaning sheet Sc is preferably conveyed through the nip N such that the cleaning image 80 is disposed opposite the fixing rotator 28 and that the downstream edge Sd of the cleaning sheet Sc in the conveyance direction D when the unfixed toner image 80*a* is fixed on the recording medium R to create the cleaning sheet Sc bearing the cleaning image 80 in the cleaning image creation mode serves as an upstream edge of the cleaning sheet Sc in the conveyance direction D in the cleaning mode.

The cleaning sheet Sc is preferably formed with the image 81 that indicates the setting orientation in which the user sets the cleaning sheet Sc in the image forming apparatus to cause the image forming apparatus to perform the cleaning mode, in addition to the cleaning image 80. The cleaning sheet Sc may be further formed with the image 82 (e.g., a character string) that indicates an instruction and a warning to the user who sets the cleaning sheet Sc in the image forming apparatus.

The cleaning method performed by the image forming apparatus according to the embodiments of the present disclosure includes a first embodiment in which, in the cleaning mode, a sheet feeding mechanism (e.g., the conveying roller 52) or the like causes the cleaning sheet Sc bearing the cleaning image 80 to pass through the nip N in a state in which the cleaning image 80 is disposed opposite the fixing rotator 28 and in which the cleaning sheet Sc is oriented in a different orientation different from an orientation in which the cleaning sheet Sc is oriented while the unfixed toner image 80*a* is fixed on the recording medium R to create the cleaning sheet Sc bearing the cleaning image 80 in the cleaning sheet creation mode. The cleaning method further includes a second embodiment in which, as the user sets the cleaning sheet Sc properly, the cleaning sheet Sc bearing the cleaning image 80 passes through the nip N in a state in which the cleaning image 80 is disposed opposite the fixing rotator 28 and in which the cleaning sheet Sc is oriented in a different orientation different from an orientation in which the cleaning sheet Sc is oriented while the unfixed toner image 80*a* is fixed on the recording medium R to create the cleaning sheet Sc bearing the cleaning image 80 in the cleaning sheet creation mode.

Since the images 81 and 82 are formed on the cleaning sheet Sc, the cleaning sheet Sc is conveyed properly in the second embodiment.

The cleaning method according to the embodiments of the present disclosure removes the toner stains adhered to the fixing rotator 28 with the recording medium bearing the toner image printed by the image forming apparatus incorporating the fixing rotator 28.

A description is provided of advantages of an image forming apparatus (e.g., the image forming apparatuses 100 and 100T).

As illustrated in FIGS. 1, 2, and 3, the image forming apparatus includes an image forming device (e.g., the image forming devices 1, 1Y, 1M, 1C, and 1K) and a fixing device (e.g., the fixing device 12).

As illustrated in FIG. 10A, the image forming device forms a toner image (e.g., the unfixed toner image 80*a*) on a recording medium (e.g., the recording medium R). The fixing device fixes the toner image on the recording medium. The fixing device includes a fixing rotator, that is, a first rotator, that rotates, a pressure rotator, that is, a second rotator, that is pressed against the fixing rotator to form a nip (e.g., the nip N) therebetween, and a heater (e.g., the heat source 33) that heats at least one of the fixing rotator and the pressure rotator. As the recording medium bearing the toner image is conveyed through the nip, the fixing rotator and the pressure rotator fix the toner image on the recording medium.

The image forming apparatus performs a cleaning mode that removes a foreign substance (e.g., a toner stain and paper dust) from a surface of the fixing rotator by passing the recording medium fixed with the toner image through the nip. The image forming apparatus further performs a cleaning sheet creation mode that creates a cleaning sheet (e.g., the cleaning sheet Sc) bearing a cleaning image (e.g., the cleaning image 80) as the fixing rotator conveys the recording medium bearing the toner image through the nip with a first orientation of the recording medium so as to fix the toner image on the recording medium. In the cleaning mode, the cleaning sheet bearing the cleaning image is conveyed through the nip with a second orientation of the cleaning sheet, that is different from the first orientation of the recording medium, in a state in which the cleaning image is disposed opposite the fixing rotator.

Accordingly, the image forming apparatus removes the toner stain adhered to the fixing rotator with the cleaning sheet bearing the cleaning image printed by the image forming apparatus incorporating the fixing rotator.

According to the embodiments described above, the fixing roller as the fixing rotator 28 serves as a fixing rotator. Alternatively, a fixing belt, a fixing film, a fixing sleeve, or the like may be used as a fixing rotator. Further, the pressure roller as the pressure rotator 30 serves as a pressure rotator. Alternatively, a pressure belt or the like may be used as a pressure rotator.

According to the embodiments described above, each of the image forming apparatuses 100 and 100T is a printer. Alternatively, each of the image forming apparatuses 100 and 100T may be a copier, a facsimile machine, a multifunction peripheral (MFP) having at least two of printing, copying, facsimile, scanning, and plotter functions, or the like.

The above-described embodiments are illustrative and do not limit the present disclosure. Thus, numerous additional modifications and variations are possible in light of the above teachings. For example, elements and features of different illustrative embodiments may be combined with each other and substituted for each other within the scope of the present disclosure.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

What is claimed is:

1. An image forming apparatus comprising:

an image forming device configured to form a toner image on a recording medium;

a first rotator configured to rotate in a rotation direction;

a second rotator configured to press against the first rotator to form a nip between the first rotator and the second rotator; and a heater configured to heat at least one of the first rotator and the second rotator, the first rotator configured to convey the recording medium bearing the toner image through the nip with a first orientation of the recording medium to fix the toner image on the recording medium so as to create a cleaning sheet bearing a cleaning image in a cleaning sheet creation mode, the first rotator configured to convey the cleaning sheet bearing the cleaning image through the nip with a second orientation of the cleaning sheet, the second orientation being different from the first orientation of the recording medium, in a state in which the cleaning image is disposed opposite the first rotator so as to cause the cleaning image to remove a foreign substance from a surface of the first rotator in a cleaning mode, the image forming apparatus further comprising:

a controller configured to control the first rotator to repeat an interrupting operation and a conveying operation for a predetermined number of times in the cleaning mode, wherein the first rotator is configured to interrupt conveyance of the cleaning sheet in the interrupting operation in a state in which the first rotator and the second rotator sandwich the cleaning sheet at the nip, wherein the first rotator is configured to convey the cleaning sheet for a length equivalent to a length of the nip in the rotation direction of the first rotator in the conveying operation, and wherein the controller is configured to rotate the first rotator in another rotation direction to convey the cleaning sheet, said another rotation direction being opposite to the rotation direction in which the first rotator rotates to fix the toner image on the recording medium, in the state in which the first rotator and the second rotator sandwich the cleaning sheet at the nip.

2. The image forming apparatus according to claim 1, wherein the cleaning sheet includes:

a first edge; and a second edge disposed downstream from the first edge in a conveyance direction in which the cleaning sheet is conveyed through the nip in the cleaning sheet creation mode, the second edge disposed upstream from the first edge in the conveyance direction in the cleaning mode.

3. The image forming apparatus according to claim 1, wherein the first rotator and the second rotator are configured to fix a setting orientation image on the recording medium in the cleaning sheet creation mode, the setting orientation image configured to indicate a setting orientation in which the cleaning sheet is oriented in the image forming apparatus in the cleaning mode.

4. The image forming apparatus according to claim 1, wherein the cleaning image includes a solid image having a maximum toner adhesion amount per unit area on the cleaning sheet.

5. The image forming apparatus according to claim 1, wherein the cleaning image is configured to define a margin having a minimum size, the margin disposed on each lateral end of the cleaning sheet in a direction perpendicular to a conveyance direction of the cleaning sheet.

6. The image forming apparatus according to claim 1, wherein a length of the cleaning image on the cleaning sheet in a conveyance direction of the cleaning sheet is not shorter than a circumference of the first rotator in a circumferential direction of the first rotator.

7. The image forming apparatus according to claim 1, wherein the controller is configured to control a temperature of the first rotator in the cleaning mode to be lower than a preset fixing temperature at which the first rotator fixes the toner image on the recording medium.

8. The image forming apparatus according to claim 7, wherein the controller is configured to control the first rotator to perform the interrupting operation and the conveying operation for the predetermined number of times that is not smaller than a number obtained by rounding up a value obtained by dividing a circumference of the first rotator by the length of the nip in a circumferential direction of the first rotator into an integer.

9. The image forming apparatus according to claim 1, wherein the first rotator and the second rotator are configured to fix an instructing image on the recording medium in the cleaning sheet creation mode, the instructing image configured to indicate an instruction and a warning for setting the cleaning sheet in the image forming apparatus in the cleaning mode.

10. The image forming apparatus according to claim 1, wherein the first rotator includes a fixing roller.

11. The image forming apparatus according to claim 1, wherein the second rotator includes a pressure roller.

12. A cleaning method comprising:

forming a toner image on a recording medium;

fixing the toner image on the recording medium to create a cleaning sheet bearing a cleaning image in a cleaning sheet creation mode while conveying the recording medium bearing the toner image through a nip formed between a first rotator and a second rotator in a state in which a first edge of the cleaning sheet is disposed upstream from a second edge of the cleaning sheet in a conveyance direction of the cleaning sheet;

removing a foreign substance from a surface of the first rotator in a cleaning mode while conveying the cleaning sheet bearing the cleaning image through the nip in a state in which the cleaning image is disposed opposite the first rotator and in which the first edge of the cleaning sheet is disposed downstream from the second edge of the cleaning sheet in the conveyance direction of the cleaning sheet;

conveying the cleaning sheet to the nip in the cleaning mode;

interrupting rotation of the first rotator for a predetermined interruption time when the cleaning sheet comes into contact with the first rotator at the nip;

resuming rotation of the first rotator for a predetermined rotation time;

determining that interruption and resumption of rotation of the first rotator are performed for a predetermined number of times; and conveying the cleaning sheet to a sheet ejection tray, wherein the first rotator rotates in another rotation direction to convey the cleaning sheet, said another rotation direction being opposite to the rotation direction in which the first rotator rotates to fix the toner image on the recording medium, in a state in which the first rotator and the second rotator sandwich the cleaning sheet at the nip.

13. The method according to claim 12, wherein:

the second edge is disposed upstream from the first edge in the conveyance direction in the cleaning mode.

14. The method according to claim 12, wherein:

the first rotator and the second rotator are configured to fix a setting orientation image on the recording medium in the cleaning sheet creation mode, the setting orientation image configured to indicate a setting orientation in which the cleaning sheet is oriented in the cleaning mode.

15. The method according to claim 12, wherein:

the cleaning image includes a solid image having a maximum toner adhesion amount per unit area on the cleaning sheet.

16. The method according to claim 12, wherein:

the cleaning image is configured to define a margin having a minimum size, the margin disposed on each lateral end of the cleaning sheet in a direction perpendicular to the conveyance direction of the cleaning sheet.

17. The method according to claim 12, wherein:

a length of the cleaning image on the cleaning sheet in a conveyance direction of the cleaning sheet is not shorter than a circumference of the first rotator in a circumferential direction of the first rotator.

* * * * *